US007554062B2

(12) United States Patent
Lee

(10) Patent No.: US 7,554,062 B2
(45) Date of Patent: Jun. 30, 2009

(54) RETRACTABLE DISPLAY UNIT

(75) Inventor: Seung-Jae Lee, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 328 days.

(21) Appl. No.: 11/281,706

(22) Filed: Nov. 18, 2005

(65) Prior Publication Data

US 2006/0219702 A1 Oct. 5, 2006

(30) Foreign Application Priority Data

Mar. 15, 2005 (KR) ..... 10-2005-0021378

(51) Int. Cl.
*H05B 1/02* (2006.01)

(52) U.S. Cl. ..... 219/506; 219/491; 219/414; 219/720; 361/681; 345/156

(58) Field of Classification Search ..... 219/412, 219/720, 506, 494, 391, 490, 491; 361/681; 345/530, 156, 204
See application file for complete search history.

(56) References Cited

U.S. PATENT DOCUMENTS 4,989,167 A 1/1991 Kapec et al.
5,715,138 A * 2/1998 Choi ..... 361/681
6,012,785 A * 1/2000 Kawasaki ..... 312/29
7,035,088 B2 * 4/2006 Pihlaja et al. ..... 361/679
2004/0125549 A1 * 7/2004 Iredale ..... 361/681
2004/0175968 A1 * 9/2004 Sasaki et al. ..... 439/72
2006/0043087 A1 * 3/2006 Gagas et al. ..... 219/391

FOREIGN PATENT DOCUMENTS

JP 63-196920 8/1988
JP 05-038981 2/1993
JP 09-231735 9/1997
KR 1020040092917 11/2004

* cited by examiner

*Primary Examiner*—Mark H Paschall
(74) *Attorney, Agent, or Firm*—Roylance, Abrams, Berdo & Goodman, L.L.P.

(57) ABSTRACT

An electronic appliance is provided including a display unit movably installed along a guide rail, a protection cover which slides between a first position covering the display unit and a second position exposing the display unit, and a connection unit connecting the sliding movement of the protection cover between the first and second positions with the movement of the display unit.

10 Claims, 7 Drawing Sheets

RETRACTABLE DISPLAY UNIT

CROSS-REFERENCE TO RELATED PATENT APPLICATIONS

This application claims the benefit under 35 U.S.C. § 119 (a) of Korean Patent Application No. 10-2005-0021378, filed on Mar. 15, 2005, the entire disclosure of which is hereby incorporated by reference.

BACKGROUND OF THE INVENTION

1. Field of the Invention

The present invention relates to an electronic appliance having a display unit. More particularly, the present invention relates to an electronic appliance enabling adjustment of an angle of inclination of a display unit.

2. Description of the Related Art

Electronic appliances including office machines such as printers or copiers may include a display unit to visually provide a user with information about the operational status of the appliance. A display unit may be installed at a fixed angle of inclination on a body of the electronic appliance. Alternatively, the display unit may be installed on the body of the electronic appliance such that a user can control the inclination angle to improve convenience of storage, transport, and use.

FIG. 1 is a cross-sectional view of a conventional electronic appliance in which an inclination angle of a display unit 2 can be adjusted, and FIG. 2 is a partial perspective view of the conventional electronic appliance of FIG. 1. Referring to FIGS. 1 and 2, the display unit 2 is pivotally installed on a body 1 of the electronic appliance about a hinge 3. A hollow portion 7 may be formed on the body such that when the display unit 2 is stored in the body 1, a user can access the display unit 2 to adjust the angle of inclination of the display unit 2. If there is no hollow portion 7 on the body 1, as indicated by a dotted line 6 in FIG. 1, a handle 8, also illustrated with a dotted line, can be mounted on the display unit 2 to enable a user to access the display unit 2. As shown in FIG. 2, a side portion 9 of the body 1 may be formed to expose a side portion 2*a* of the display unit 2.

Recently, the outer designs of electronic appliances have become increasingly commercially important. However, it is relatively difficult to creatively design such an electronic appliance with the above structure, while also allowing the inclination angle of the display unit 2 to be adjusted.

Conventionally, as shown in FIGS. 1 and 2, a first plurality of projections 4 are formed about the hinge 3 in the display unit 2 to fix the display unit 2 at various angles of inclination. A second plurality of projections 5*a*, which are shaped complementary to the first projections 4, are formed on the body 1. The second plurality of projections 5*a* are mounted on a resilient variable tension arm 5. For external design considerations, the first and second projections 4 and 5*a* must be placed as close to the hinge 3 as possible to avoid being exposed to the outside. In this case, the product of the distance from the hinge 3 to the first and second projections 4 and 5*a* and the reaction force applied to the first and second projections 4 and 5*a*, should be the same as the product of the dead load of the display unit 2 and the distance from the hinge 3 to the center of mass of the display 2. Consequently, as the distance between the hinge 3 and the first and second projections 4 and 5*a* decreases, the reaction force applied to the first and second projections 4 and 5*a* increases. Moreover, the elastic force generated by the tension arm 5 must be greater than the reaction force applied to the first and second projections 4 and 5*a*. Therefore, a larger force is needed to adjust the inclination angle of the display unit 2. Further, due to repeated inclination angle adjustment, the first and second projections 4 and 5*a* tend to wear or the tension arm 5 may lose its elasticity.

Also, since the display unit 2 is exposed, the display unit 2 may be destroyed when the electronic appliance is stored or transported.

Accordingly, there is a need for an electronic appliance with an improved external design to prevent damage during storage and transport, which can also adjust an angle of inclination of a display unit with a relatively small force.

SUMMARY OF THE INVENTION

Exemplary embodiments of the present invention address at least the above problems and/or disadvantages and provide at least the advantages described below. Accordingly, an aspect of the present invention is to provide an electronic appliance which can relatively easily and reliably adjust an angle of inclination of a display unit with a small force.

The exemplary embodiments of the present invention also provide an electronic appliance which can adjust an angle of inclination of a display unit while preserving external design considerations.

Further, the exemplary embodiments of the present invention also provide an electronic appliance which can prevent damage to a display unit during storage and transport.

According to another exemplary aspect of the present invention, there is provided an electronic appliance comprising a body including a guide rail, a display unit which is movably arranged on the body along the guide rail such that the angle of inclination of the display unit can be adjusted, a protection cover which is arranged on the body and slides between a first position covering the display unit and a second position exposing the display unit, and a connection unit which connects the sliding movement of the protection cover between the first and second positions with the movement of the display unit.

The electronic appliance may further comprise a motor sliding the protection cover and moving the display unit using the connection unit.

The electronic appliance may further comprise a locking assembly which locks the display unit in a plurality of positions on the guide rail so that the display unit can have various angles of inclination.

According to another exemplary implementation of the present invention, there is provided an electronic appliance comprising a body, a display unit movably arranged on the body, and a protection cover which is arranged on the body which covers the display unit when in a first position and exposes the display unit when in a second position.

The electronic appliance may further comprise a central axis arranged on a arc shaped path which is located outside the display unit, the display unit is embedded inside the body when the protection cover is disposed in the first position and the display unit is moved along the arc shaped path as the protection cover is moved toward the second position, thereby adjusting the angle of inclination of the display unit.

Other objects, advantages, and salient features of the exemplary embodiments of the invention will become apparent to those skilled in the art from the following detailed description, which, taken in conjunction with the annexed drawings, discloses exemplary embodiments of the invention.

BRIEF DESCRIPTION OF THE DRAWINGS

The above and other features and advantages of the exemplary embodiments of the present invention will become more apparent by describing in detail exemplary embodiments thereof with reference to the attached drawings in which.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 3:
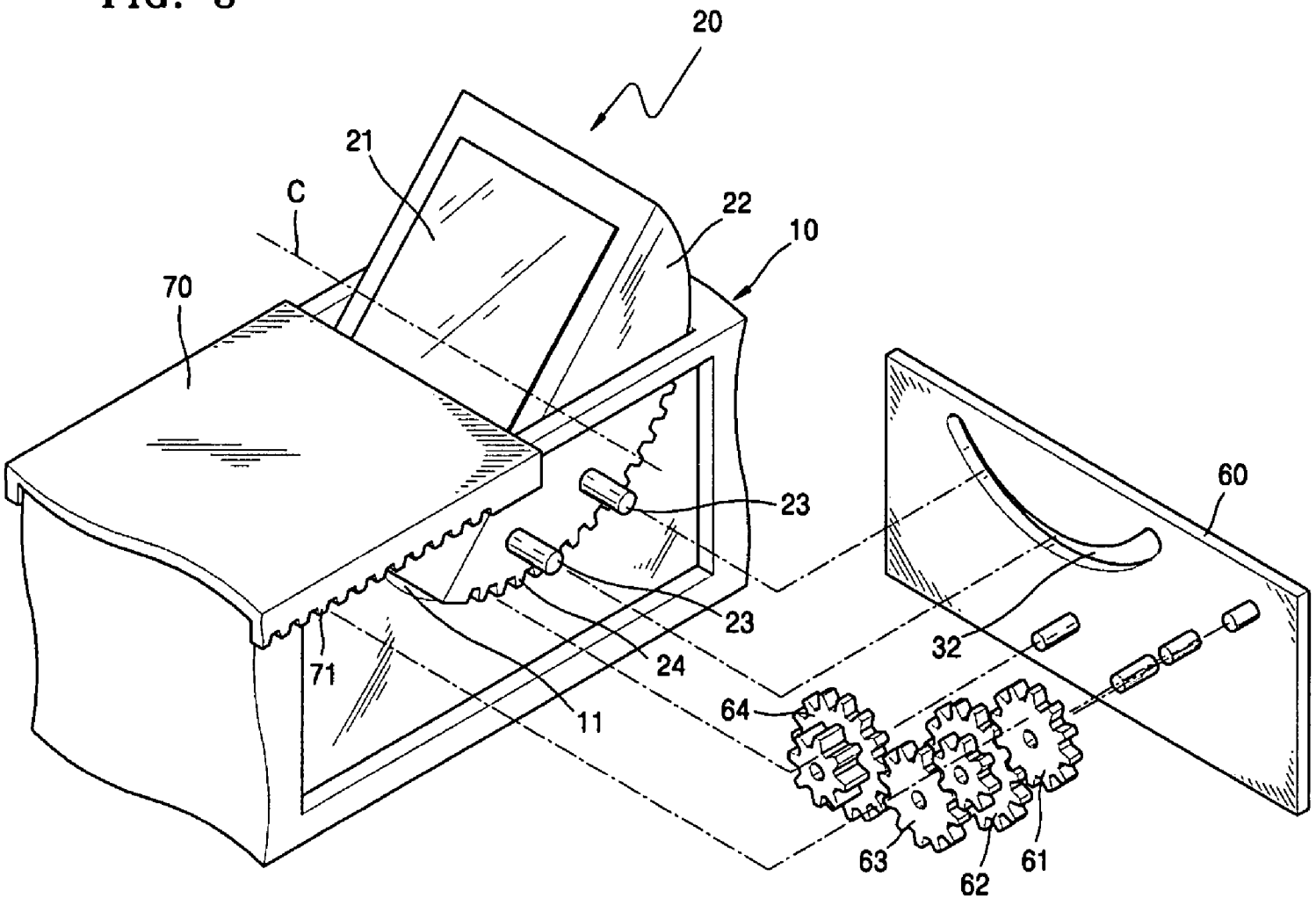
FIG. 3 is an exploded perspective view of an electronic appliance according to an exemplary embodiment of the present invention.
Figure 4:
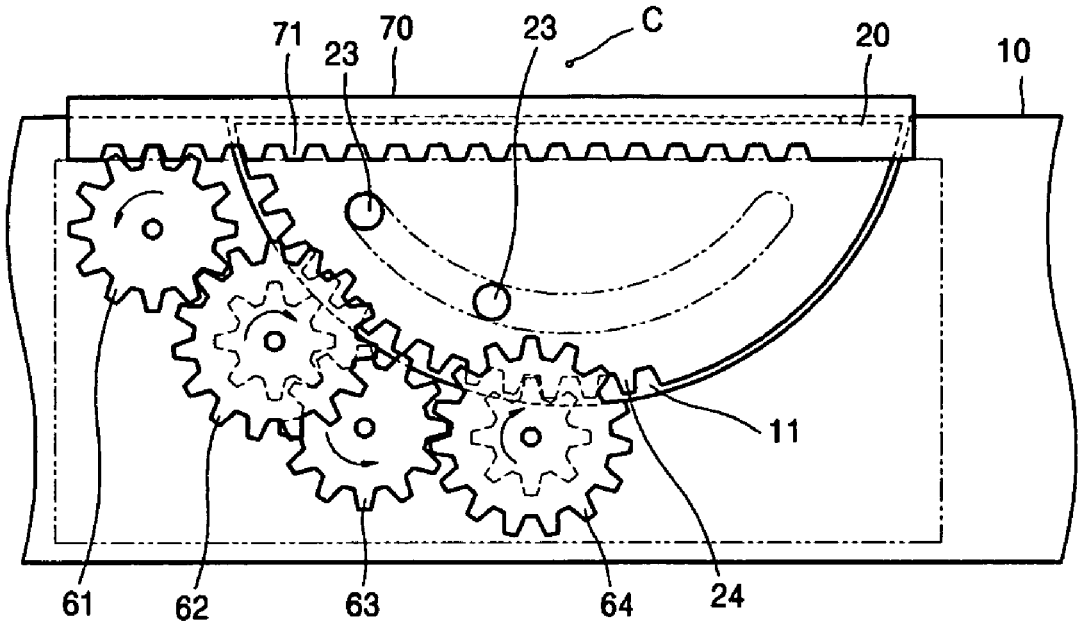
FIGS. 4 and 5 are side views illustrating operations when a display unit is adjusted.

FIGS. 3 and 4 are respectively an exploded perspective view and a side view of an electronic appliance according to an exemplary embodiment of the present invention. Referring to FIG. 3, the electronic appliance according to the present exemplary embodiment includes a body 10 and a display unit 20. The body 10 performs the primary functions of the electronic appliance, which may be, for example, an office automation device such as a printer, a multifunctional printer or a point of sale (POS) system, a household electrical appliance, or a measurement device. The portion performing the primary functions is omitted from the body 10 illustrated in FIG. 3. The display unit 20 may be, for example, a cathode ray tube (CRT) or a liquid crystal display device, which can display information.

The display unit 20 is installed on the body 10 such that an inclination angle of the display unit 20 can be adjusted. As an example, referring to FIG. 3, a receiving portion 11 that receives the display unit 20 is formed in the body 10. A bracket 60 is connected to a side of the receiving portion 11. An arc-shaped guide rail 32 is formed on the bracket 60. A guide rail 31 (referring to FIG. 6) corresponding to the guide rail 32 is formed on the other side of the receiving portion 11. The display unit 20 is configured to move along the guide rails 31 and 32. Two or more projections 23 configured to be inserted into the guide rails 31 and 32 are mounted on each side 22 of the display unit 20. When three or more projections 23 are formed, the projections 23 can be arranged, for example, on a circular arc which is concentric with the central axis C of the guide rails 31 and 32. The central axis of the guide rails 31 and 32 is located, for example, outside a display window 21 of the display unit 20. With the above structure, the inclination angle of the display unit 20 can be adjusted by moving the display unit 20 along the guide rails 31 and 32.

A protection cover 70 is coupled with the body 10 and slides in association with the movement of the display unit 20. The protection cover 70 opens and closes the receiving portion 11 by sliding between first and second positions. The first position covers the display unit 20 and the second position exposes the display unit 20. A connection unit is provided to allow the protection cover 70 to slide between the first and second positions. The connection unit includes a gear such as a rack gear 71 formed on the protection cover 70, a pinion 24 formed on the display unit 20, and a plurality of gears 61, 62, 63, and 64 connecting the rack gear 71 to the pinion 24. The pinion 24 may be concentric with the guide rails 31 and 32. The gears 61,62,63, and 64 are rotatably coupled to the bracket 60.

Figure 5:
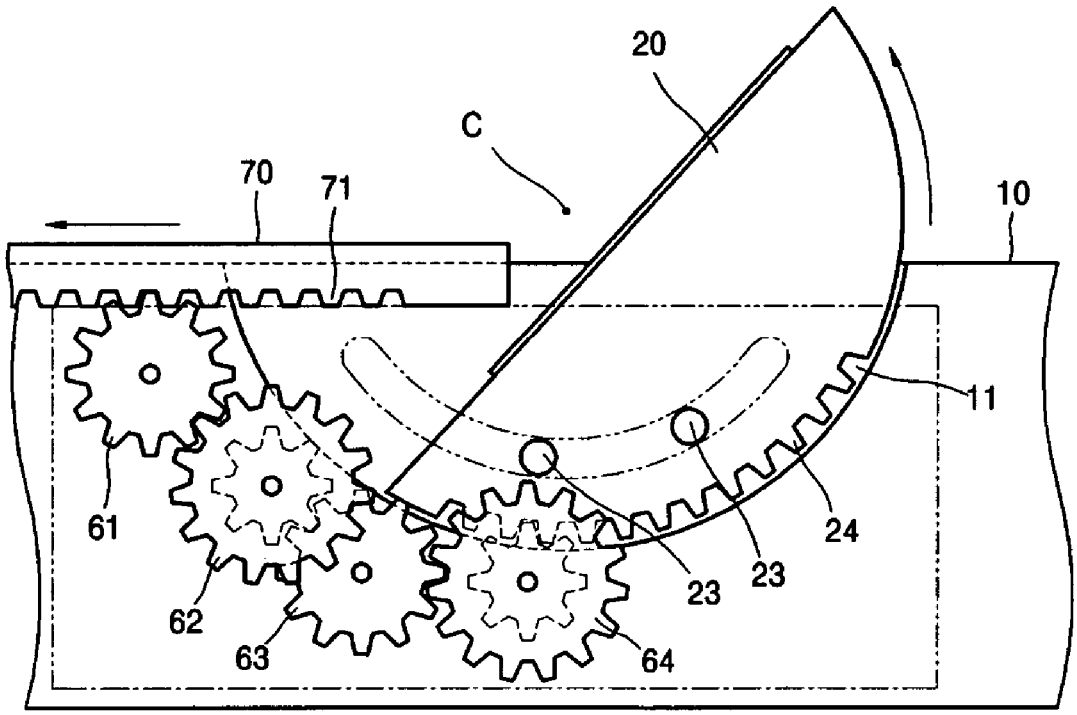

Referring to FIG. 4, at the first position, the protection cover 70 covers the display unit 20, which is entirely disposed in the receiving portion 11. When the protection cover 70 slides to the second position, the display unit 20 moves along the guide rails 31 and 32. Accordingly, the inclination angle of the display unit 20 changes as shown in FIG. 5. Thus, the inclination angle of the display unit 20 can be adjusted by sliding the protection cover 70.

Figure 6:
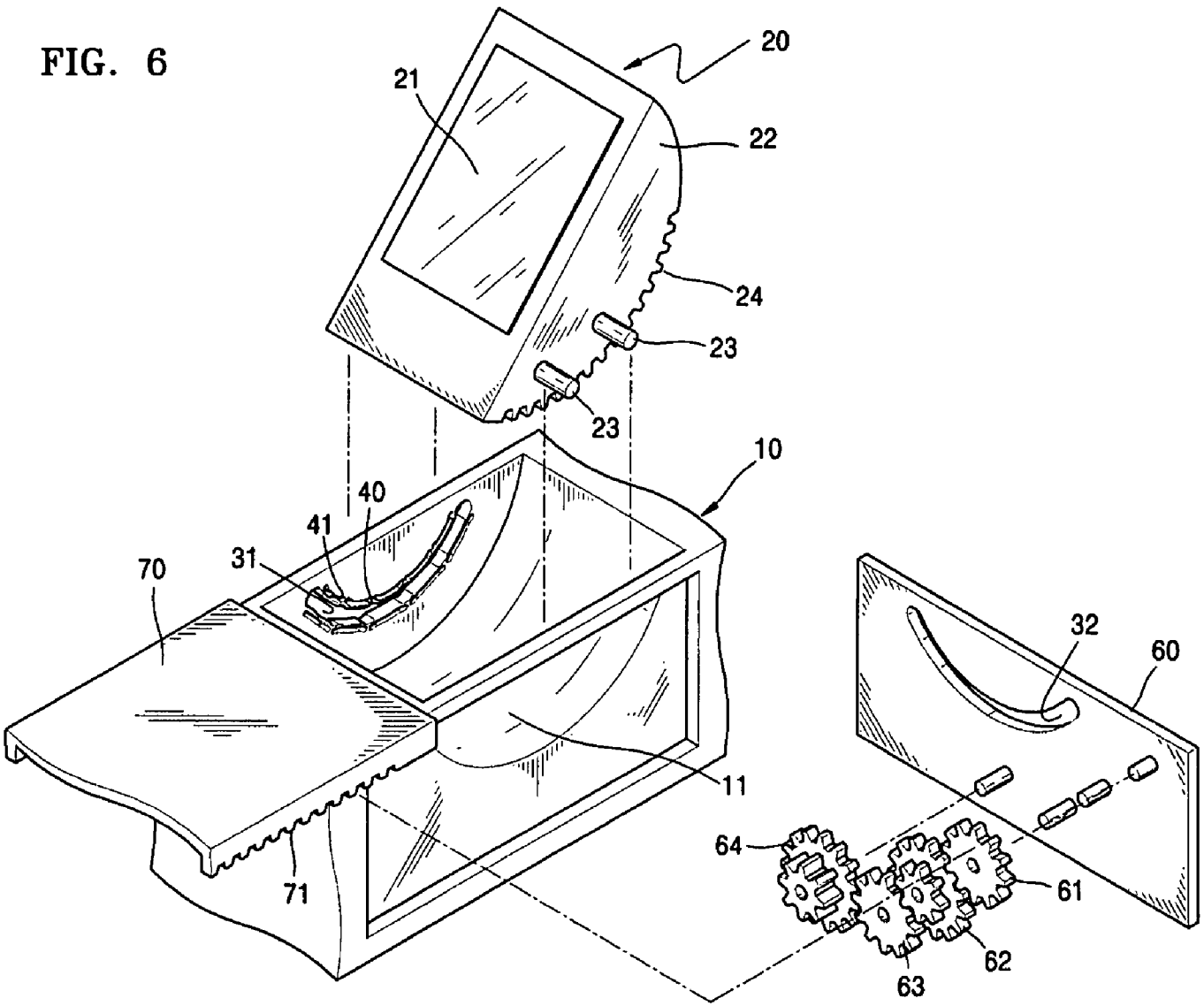
FIG. 6 is an exploded perspective view of an electronic appliance including a locking member according to an exemplary embodiment of the present invention.

FIG. 6 is an exploded perspective view of an electronic appliance according to another exemplary implementation of the present invention. The electronic appliance includes a locking assembly enabling locking of the display unit 20 in a plurality of positions to allow various angles of inclination. Referring to FIG. 6, the locking assembly may include, for example, a plurality of tension ribs 40 disposed along the guide rail 31. A plurality of penetration portions 41 allow the plurality of tension ribs 40 to elastically deform when being pushed by projections 23. The projections 23 can be locked between the plurality of tension ribs 40. In turn, the display unit 20 is locked due to the elasticity of the tension ribs 40. To adjust the angle of inclination of the display unit 20, a user slides the protection cover 70. Therefore, the tension ribs 40 deform, and the projections 23 release from the locking position. Then, the display unit 20 moves along the guide rail 31.

The protection cover 70 stops when the display unit 20 reaches a position between the tension ribs 40. Thus, the angle of inclination of the display unit 20 can be locked after being varied. Since the guide rails 31 and 32 are slightly curved, the display unit 20 can be relatively easily moved along the guide rails 31 and 32 by a small force. Thus, the risk of damaging the projection 23 is reduced. In the electronic appliance according to this exemplary embodiment, the display unit 20 and a body 10 are not actually connected with each other at the central axis of the guide rails 31 and 32. Further, since the display unit 20 is supported by the plurality of projections 23, which are away from the central axis of the guide rails 31 and 32, the reaction force applied to the projections 23 and the tension ribs 40 due to the dead load of the display unit 20 is relatively small. Therefore, the risk of damaging the projections 23 can be reduced.

Figure 7:
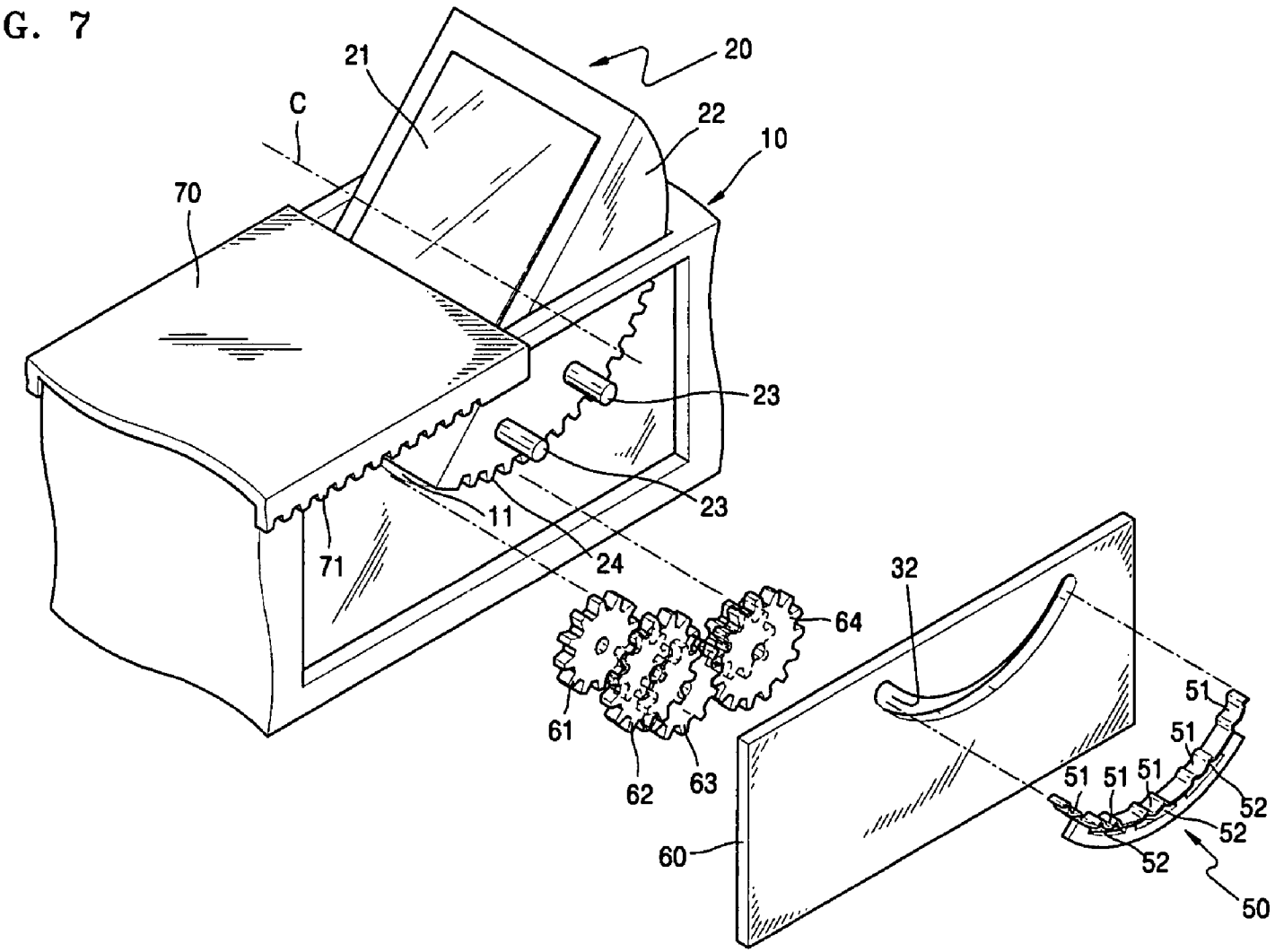
FIG. 7 is an exploded perspective view of an electronic appliance including a locking member according to another exemplary embodiment of the present invention.

FIG. 7 is an exploded perspective view of an electronic appliance including a locking member according to another exemplary implementation of the present invention.

Referring to FIG. 7, a resilient member 50 is coupled to the bracket 60. The elastic member 50 serves as the locking assembly for the electronic appliance. The resilient member 50 includes a plurality of resilient supporting portions 51 formed along the guide rail 32. The resilient supporting portions 51 are shaped to elastically support the projections 23. According to this exemplary embodiment, the elastic supporting portions 51 are substantially arc shaped to support lower parts of the projections 23. The projections can be, for example, circular. An elastic support 52 is formed on a lower part of the elastic supporting portion 51 so that, when the proper force is applied to the display unit 20, the elastic supporting portion 51 elastically deforms, allowing the movement of the display unit 20, and when the applied force is removed from the display unit 20, the elastic supporting portion 52 supports the projection 23, thereby elastically locking the display unit 20 in a corresponding position. The resilient member 50 may be composed of plastic or metal having elasticity. In addition, a plurality of elastic members, each having a single elastic supporting portion 51, may be disposed along the guide rails 31 and 32.

Figure 1:
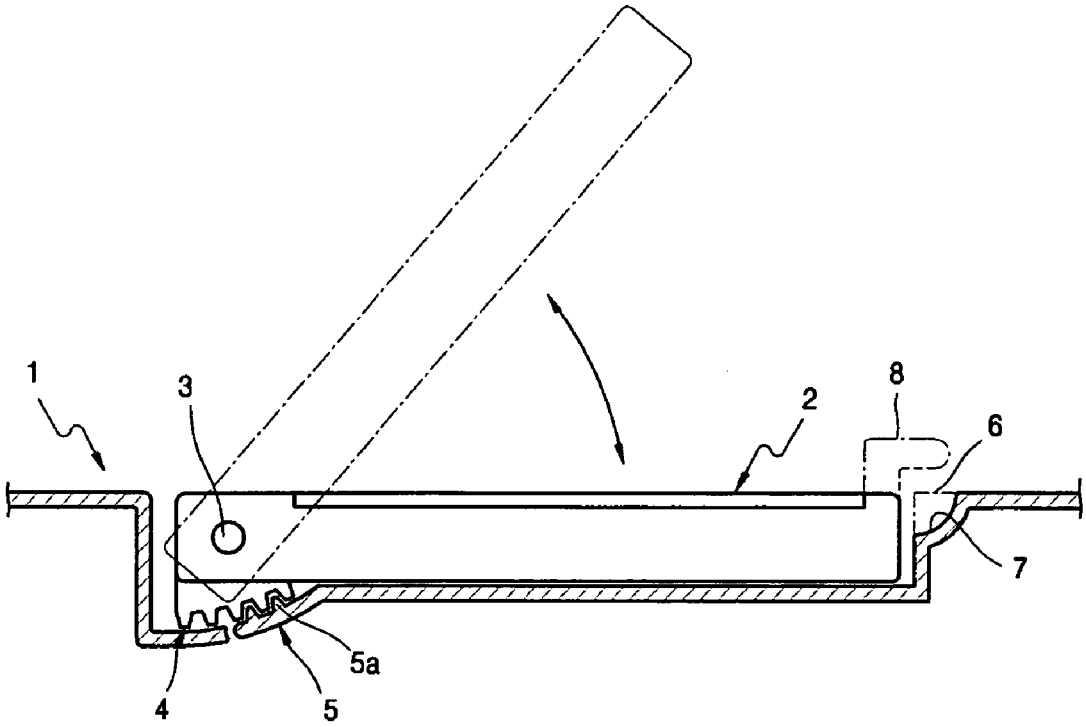
FIG. 1 (PRIOR ART)
FIG. 1 is a schematic cross-sectional view of a conventional electronic appliance in which an inclination angle of a display unit can be adjusted.
Figure 2:
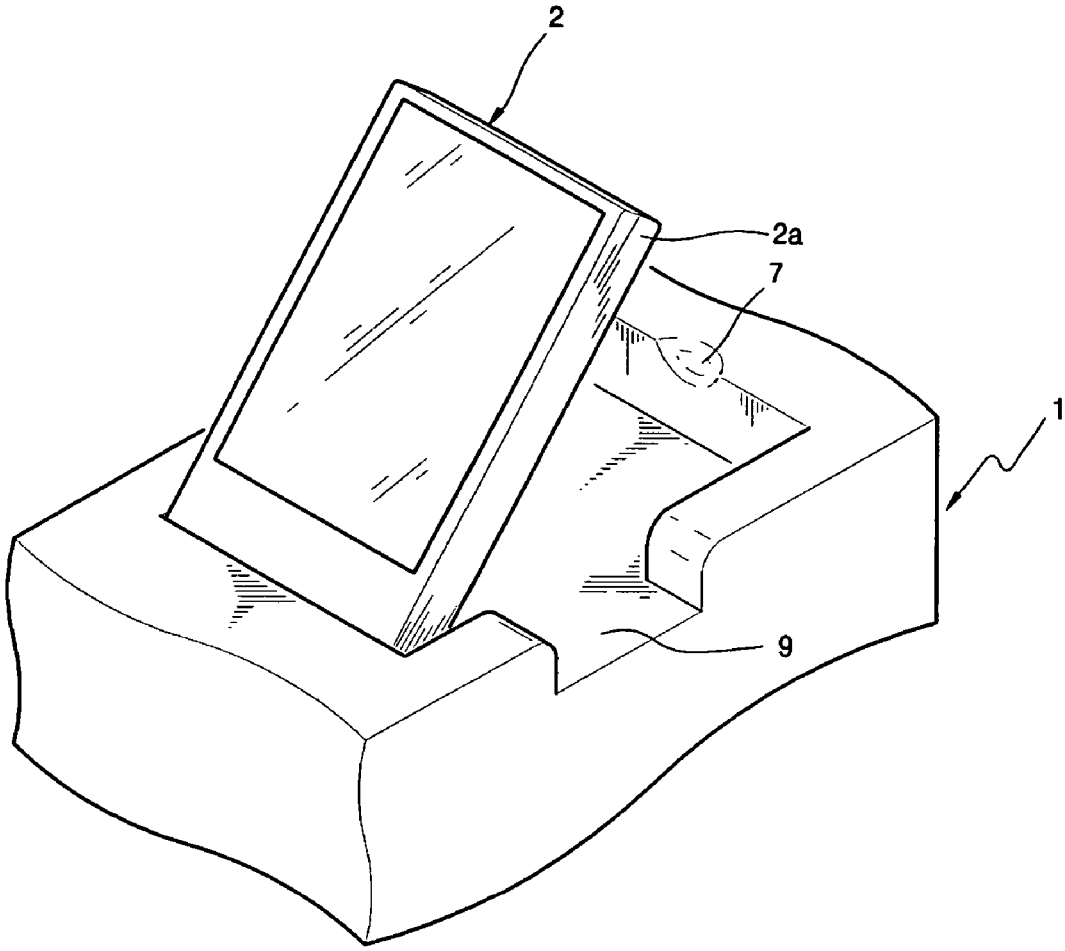
FIG. 2 (PRIOR ART)
FIG. 2 is a schematic perspective view of the conventional electronic appliance of FIG. 1.

According to the exemplary embodiment, when the protection cover 70 slides, the angle of inclination of the display unit 20 is relatively easily adjusted. As a result, the hollow portion 7 or the handle shown in FIG. 1 is not needed. Further, the side portion 9 of the body 10 exposing the side portion 2*a* of the display unit 2 is not needed. Accordingly, it is possible to implement an electronic appliance with an improved external design which enables adjustment of the angle of inclination of the display unit 20. Moreover, the protection cover 70 configuration reduces the risk of damage to the display unit 20.

Figure 8:
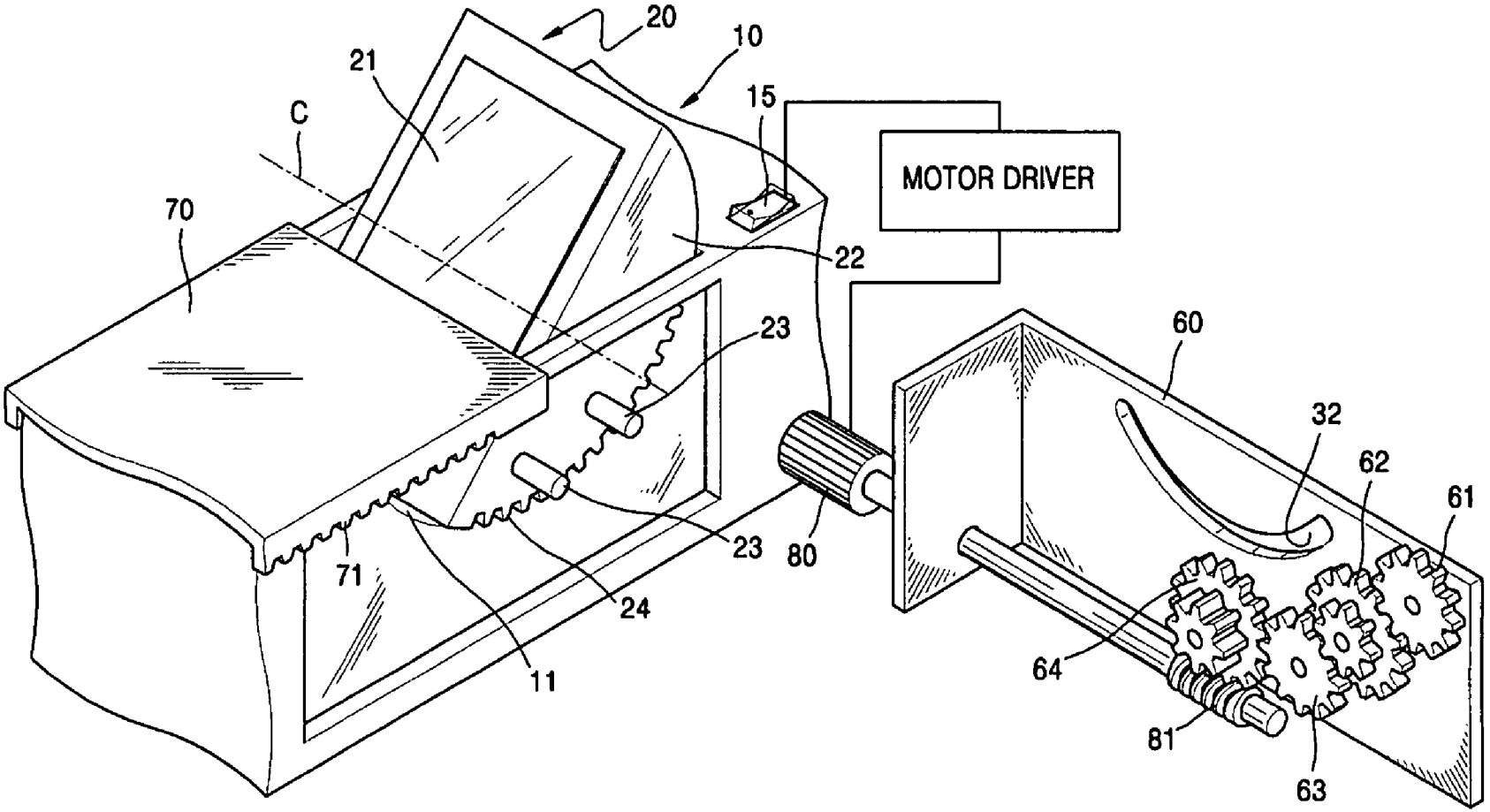
FIG. 8 is an exploded perspective view of an electronic appliance including a driving motor according to an exemplary embodiment of the present invention.

FIG. 8 is an exploded perspective view of an electronic appliance according to still yet another exemplary implementation of the present invention. The electronic appliance further includes a motor 80 to drive a connection unit. For example, the motor 80 includes a worm gear 81. The worm gear 81 is connected to a gear 64. An operation button 15 is installed in the body 10 to control the rotation direction of the motor 80. A user can adjust the angle of inclination of the display unit 20 by rotating the motor 80 clockwise/counterclockwise. The protection cover 70 slides in connection with the movement of the display unit 20.

As described above, an electronic appliance according to the exemplary embodiment of the present invention can obtain the following effects.

First, due to the protection cover configuration, the risk of damage to a display unit is reduced.

Second, it is possible to implement an electronic appliance with a improved design, which includes a display unit whose angle of inclination is adjustable.

Third, a display unit moves along curved guide rails in association with the sliding movement of a protection cover so that the angle of inclination of the display unit can be adjusted with a relatively small force, and the display unit can be fixed at various angles of inclination.

Fourth, since a motor can be additionally installed, a user can more conveniently adjust the angle of inclination of a display unit.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An electronic appliance comprising:

a body comprising a guide rail;

a display unit slidably displaceable from and arranged in the body along the guide rail such that the angle of inclination of the display unit can be adjusted;

a protection cover slidably arranged on the body and displaceable between a first position covering the display unit and a second position exposing the display unit; and a connection unit which connects the sliding movement of the protection cover between the first and second positions, wherein the display unit is slidably displaceable responsive to displacement of the protection cover.

2. The electronic appliance of claim 1, wherein the connection unit comprises:

a rack gear formed on the protection cover;

a pinion formed on the display unit; and a plurality of gears connecting the rack gear to the pinion.

3. The electronic appliance of claim 2, wherein the pinion is concentric with the guide rail.

4. The electronic appliance of claim 1, further comprising:

a motor configured to slide the protection cover and move the display unit using the connection unit.

5. The electronic appliance of claim 4, further comprising:

an operation member controlling the driving direction of the motor.

6. The electronic appliance of claim 4, wherein the connection unit comprises:

a rack gear formed on the protection cover;

a pinion formed on the display unit; and a plurality of gears connecting the rack gear to the pinion.

7. The electronic appliance of claim 1, further comprising:

a locking assembly which locks the display unit in a plurality of positions on the guide rail such that the display unit can have various angles of inclination.

8. The electronic appliance of claim 1, wherein the guide rail is substantially arc shaped.

9. The electronic appliance of claim 1, wherein a central axis of the guide rail is located outside of the display unit.

10. An electronic appliance comprising:

a body comprising a substantially arc shaped guide rail formed therein;

a display unit which is installed in the body movably along the guide rail such that the angle of inclination of the display unit can be adjusted;

a protection cover which is installed on the body, covers the display unit in a first position and exposes the unit in a second position; and a connection unit which connects the sliding movement of the protection cover between the first and second positions with the movement of the display unit, wherein a central axis of the guide rail is located outside the display unit, the display unit is arranged inside the body when the protection cover is disposed in the first position and the display unit is moved along the arc shaped path responsive to the protection cover being moved toward the second position, thereby adjusting the angle of inclination of the display unit.

* * * * *